United States Patent [19]

Sturm

[11] 4,218,300

[45] Aug. 19, 1980

[54] COVERING FOR A CELL FOR FUSED SALT ELECTROLYSIS

[75] Inventor: Alfred Sturm, Steinen-Husinge, Fed. Rep. of Germany

[73] Assignee: Swiss Aluminium Ltd., Chippis, Switzerland

[21] Appl. No.: 63,346

[22] Filed: Aug. 2, 1979

[30] Foreign Application Priority Data

Aug. 24, 1978 [CH] Switzerland ..... 8979/78

[51] Int. Cl.[2] ..... C25C 3/22

[52] U.S. Cl. ..... 204/247

[58] Field of Search ..... 204/67, 243 R–247

[56] References Cited

U.S. PATENT DOCUMENTS

| | | | |
|---|---|---|---|
| 3,673,074 | 6/1972 | Hirt et al. | 204/247 X |
| 3,935,090 | 1/1976 | Petrusenko et al. | 204/243 |
| 3,948,749 | 4/1976 | Sargent | 204/243 R X |
| 4,033,846 | 7/1977 | Engesland | 204/247 |
| 4,043,892 | 8/1977 | Gonzalez et al. | 204/247 |
| 4,136,003 | 1/1979 | Arnason et al. | 204/247 |

*Primary Examiner*—John H. Mack
*Assistant Examiner*—D. R. Valentine
*Attorney, Agent, or Firm*—Bachman and LaPointe

[57] ABSTRACT

The covering sytem for a conventional fused salt electrolytic cell for the reduction of aluminum oxide to metallic aluminum comprises individual lids (4) butting onto each other at the sides and inclined downwards from the anode beam (1) to the edges (5) of the long sides of the reduction pot. The lids (4) are provided with a support (6) which rests on a rail (13) when the anode beam is in the raised position. As the anode beam (1) is lowered, the lids (4) slide over the long edges (5) of the pot, until they are supported by the stops (7) mounted on the lower third part of the lid (4). On lowering the beam (1) further, the supports (6) slide on the anode beam (1). The anode rods (2) are enclosed at the sides by the lids (4).

10 Claims, 3 Drawing Figures

COVERING FOR A CELL FOR FUSED SALT ELECTROLYSIS

BACKGROUND OF THE INVENTION

The invention relates to a cell for the fused salt electrolytic reduction of aluminum oxide for the production of metallic aluminum, the said cell comprising an insulated tank or pot lined with carbon, an anode beam which runs longitudinally above the pot and can be lowered, anode rods which are mounted in rows on both sides of the anode beam, if desired devices mounted to the anode beam between the anode rods, a duct for collecting waste gases positioned along the middle between both rows of anode rods, and a covering comprising individual lids which are inclined downwards from the anode beam to the longitudinal edge of the pot and butt onto each other at their sides.

During the conventional production of aluminum by the fused salt electrolytic reduction of aluminum oxide, waste gases are produced. Before releasing these exhaust gases to the atmosphere, it is necessary to collect them and lead them to a scrubber unit.

It is known to meet this requirement by covering the reduction cell on all sides and conducting the gases off through a duct situated above the anode beam.

Some of the known systems comprise essentially a covering which is mounted horizontally below the anode beam, covering the anode rods (DE-OS 2 330 557) or the anode carbon blocks (DE-OS 2 251 898), and a further covering connected to the extremities of the horizontal covering and running at a slope down to the edge of the pot, the inclined covering being subdivided into individual lids which can be raised singly or simultaneously by means of a frame to allow maintainance operations on the cell.

It is also known to employ a covering which is mounted on the anode beam itself (DE-OS 2 510 400), is inclined downwards from the anode beam to the longitudinal edge of the pot and can be tilted upwards about pivotal axes running in the longitudinal direction of the cell.

Patent DE-OS 2 263 348 describes a covering system comprising lid components which cover the whole of the electrolytic cell and can be slid inside each other. To carry out maintainance operations to the cell, a large part of the cell has to be uncovered by sliding back whole parts of the covering.

The covering systems representing the state of the art are relatively expensive and give rise to not insignificant difficulties. For example, when changing the anodes, either a large part of the cell must be uncovered and a large amount of waste gas released to the pot room, or else the change of anodes can not be carried out without considerable difficulty. To charge the cell with alumina or to pierce the crust, the covering must be raised along the whole length of the cell to allow proper maintainance work to be carried out, which again means releasing a considerable amount of waste gas. Furthermore, mounting the auxiliary beams normally used to raise the anode beams can not always be carried out without some difficulty.

A further disadvantage of the coverings representing the state of the art is that effective collection of the waste gases can be achieved only at relatively high cost. Furthermore, the retrofitting of existing non-hooded cells—if at all possible—can be carried out only at relatively high expense.

An object of the invention is therefore to develop a covering for a cell for fused salt electrolysis which allows existing, conventional electrolytic cells to be retrofitted, simply and made ecologically acceptable. It is a further object of the invention to make it possible to change anodes and to raise the anode beam with the existing facilities. Furthermore, it should be possible for one single man to manipulate the covering without need of additional facilities. The covering should also demonstrate a good cost/efficiency ratio.

SUMMARY OF THE INVENTION

These objects are achieved by way of the present invention in that the anode beam is provided on both sides with at least one rail on which the lid rests at least at the start of the lowering of the anode beam, held there by supports mounted at the edge of the lid on the side facing the anode beam, enclosing the anode rods at the side and the other end of the lids resting freely on the longitudinal edge of the pot.

The necessary electrical insulation of the lid is provided, for example by means of an insulating layer on the lid or on the anode beam and/or by means of alumina at the edge of the pot.

The height of the pot at the side of cells for fused salt electrolysis, in particular in the case of existing pots, is generally too small to prevent these lids from coming to rest on the pot room floor when the anode beam is lowered. In an advantageous version of the present invention, therefore, stops are provided on the lower third part of the lids.

After the anode beam has been lowered a certain distance, the stops come to rest on the edge of the pot; as the beam is lowered further the lids remain stationary and the sides of the lids or the supports slide against the anode beam.

In a further advantageous embodiment of the present invention at least one facility for manipulating the lid, preferably in the form of a handle, is provided on each lid.

For the charging of alumina or other additions to the pot, and for the removal of aluminum there are provided on both sides of the cell at least one lid which, in keeping with the invention, has an opening (14) which can be closed off, usefully by means of a self-closing flap which can be pushed towards the interior of the cell and returns automatically under the action of a spring.

The air-tightness of the covering of the present invention can be improved by providing a layer of flexible, heat-resistant material e.g. asbestos, at the side next to the anode beam and on at least one side of each lid where it butts onto the adjacent lid.

It has also been found particularly advantageous to improve the rigidity by making the lids out of corrugated or angularly ridged sheet mounted in a frame. Angular ridging of the sheet, running parallel to the edge of the pot in the form of steps, makes it possible to carry out small repair jobs around the anode beam during the operation of the cell without requiring further facilities.

The resistance to sliding between the anode beam and the edge of the lid or the support on the lid next to the said beam can be reduced by fitting a roller to the supports.

Facilities fitted to the anode beam e.g. drive units for crust breakers are usefully enclosed in box-like enclosures whereby the box-like enclosure has a lid at its side.

According to another, likewise advantageous embodiment of the present invention, the lid has the same width as the box-like enclosure and rests on a rail mounted on the box-like enclosure.

The covering on the small side of the electrolytic cell comprises for example a two piece, vertical sidewall both parts of which engage flexibly with each other. The upper part is insulated from and attached to the anode beam, the lower part is likewise insulated and attached to the edge of the pot.

The device according to the invention will now be explained in greater detail with the help of schematic drawings viz., FIG. 1: An end view of the covering with the anode beam in the raised position.

FIG. 2: An end view of the covering with the anode beam in the lowered position.

FIG. 3: A plan view of the covering.

DETAILED DESCRIPTION

Figure 1:
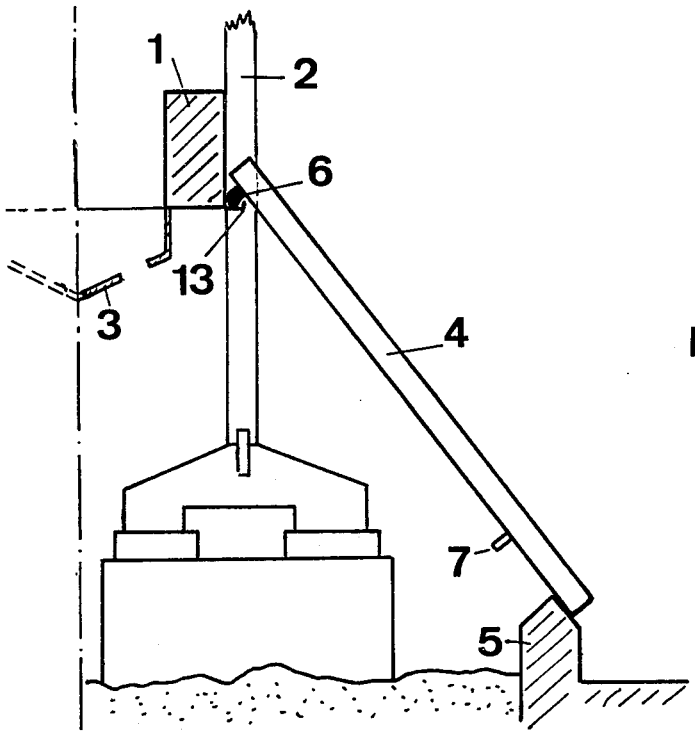

Above the electrolytic cell an anode beam (1) runs along the longitudinal axis of the cell with anode rods (2) attached to it, and a duct (3) is provided for collecting waste gases. The lids (4) extend from the anode beam to the long side (5) of the pot.

Supports (6) are provided near the edge of the lid (4) on the side facing the anode beam, and in the lower third part of the lid there are stops (7) which limit the distance the lid can slide.

As shown in FIG. 1, the supports (6) rest on the rail (13) when the anode beam (1) is in the raised position. As the anode beam is lowered, the lids (4) slide over the long edge of the pot until the stops (7) rest against the edge of the pot. As the anode beam (1) is lowered further, as shown in FIG. 2, the supports (6) of the now stationary lids slide against the anode beam.

Handles (8) are provided on the lids to allow the lids to be removed from the cell.

Figure 2:
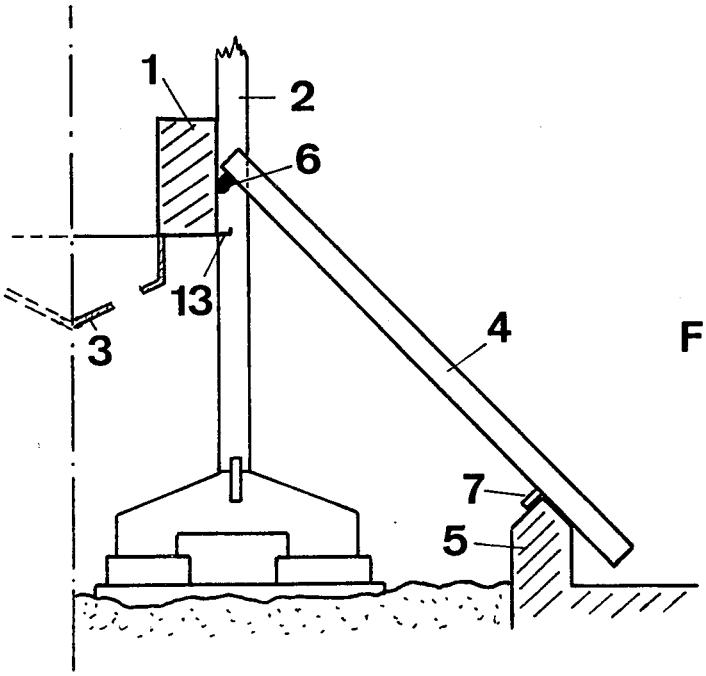

As FIG. 2 shows, the lids enclose the anode rods at the sides.

Figure 3:
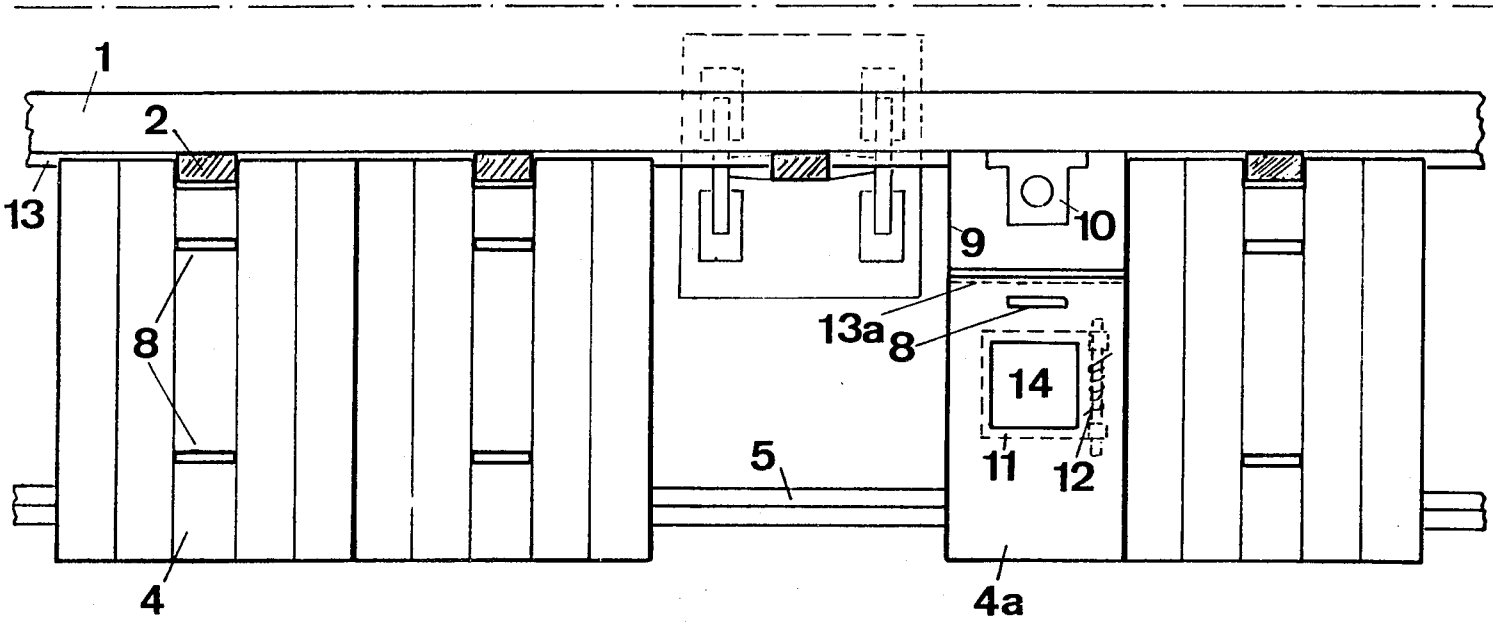

The lid (4*a*) has, as shown in FIG. 3, the same width as the box-shaped covering (9) over the drive unit (10) for the crust breaker, wherein said covering (9) comprises vertical walls positioned perpendicular to each other with further rails (13*a*) mounted on the walls of the covering. Provided on this lid is an opening (14) with a flap (11) which can be pushed inwards towards the cell interior and closes again automatically by means of a device with a spring (12) mounted on the back of the lid.

The advantages achieved by the invention are in particular that conventional electrolytic reduction cells can be retrofitted economically and with little disturbance to normal production. To carry out a change of anodes one only has to raise the appropriate lid; the charging of the alumina and the removal of aluminum takes place through an opening with a self-closing flap, which ensures that the amount of waste gas emitted to the pot room during the maintainance of the cell is markedly reduced. The raising of the anode beam can be carried out with existing equipment i.e. by positioning an auxiliary beam over the anode beam, without hindrance from the covering system according to the invention.

What is claimed is:

1. Electrolytic cell for the fused salt electrolytic reduction of aluminum oxide to metallic aluminum, comprising a pot lined with carbon, said pot having long sides, an anode beam which runs longitudinally above the cell and which can be raised and lowered, anode rods mounted on the side of the anode beam, a covering inclined downwards from the anode beam to the long sides of the pot and comprising individual lids butting onto each other at the sides thereof, in which in the region of the anode beam at least one rail is mounted on the side of the said beam on which rail the lids rest and a support mounted at the edge of the lid on the side facing the anode beam for holding up said lid at least when the anode beam is in the raised position, wherein said lids rest freely on the long sides of the reduction pot.

2. Electrolytic reduction cell according to claim 1 wherein the rails are attached to the anode beam and the anode rods are closed in at the sides by the lids.

3. Electrolytic reduction cell according to claim 2 including devices mounted on the anode beam between the anode rods, said devices being closed in at the sides by the lids.

4. Electrolytic reduction cell according to claim 2 including devices on said cell enclosed by a box-like covering comprising vertical walls positioned perpendicular to each other, and including further rails mounted on the walls of the covering, wherein said lids are the same width as said walls.

5. Electrolytic reduction cell according to claim 1 wherein stops are provided on the lower third part of the lids.

6. Electrolytic reduction cell according to claim 1 wherein at least one handling facility is provided on each lid for removing the lid from the cell.

7. Electrolytic reduction cell according to claim 1 wherein on the side of the cell there is at least one closure with a closable opening.

8. Electrolytic reduction cell according to claim 7 wherein the closure for the opening comprises a flap which can be pushed towards the interior of the cell and is self-closing under the action of a spring.

9. Electrolytic reduction cell according to claim 1 wherein the lids are provided with a layer of a flexible, heat resistant material.

10. Electrolytic reduction cell according to claim 1 wherein the lids are made of corrugated or angularly ridged sheet mounted in a frame.

* * * * *